US006220993B1

(12) United States Patent
Sencil

(10) Patent No.: US 6,220,993 B1
(45) Date of Patent: Apr. 24, 2001

(54) LEG PRESS MACHINE

(75) Inventor: Philip Sencil, Ocala, FL (US)

(73) Assignee: MedX 96, Inc., Ocala, FL (US)

( * ) Notice: Subject to any disclaimer, the term of this patent is extended or adjusted under 35 U.S.C. 154(b) by 0 days.

(21) Appl. No.: 09/365,777

(22) Filed: Aug. 3, 1999

(51) Int. Cl.[7] ..... A63B 21/06
(52) U.S. Cl. ..... 482/97; 482/137
(58) Field of Search ..... 482/94, 97–100, 482/136, 137

(56) References Cited

U.S. PATENT DOCUMENTS 4,822,038 * 4/1989 Maag ..... 482/97
5,263,914 * 11/1993 Simonson et al. ..... 482/99
5,366,432 * 11/1994 Habing et al. ..... 482/100
5,462,507 * 10/1995 Nichols et al. ..... 482/104
5,484,365 * 1/1996 Jones et al. ..... 482/97

* cited by examiner

*Primary Examiner*—John Mulcahy
(74) *Attorney, Agent, or Firm*—William E. Mouzavires

(57) ABSTRACT

A leg press machine includes a movement arm including a footboard and a pair of links pivotally mounting the footboard to a frame for movement by an exerciser's feet. A resistance arm is mounted to the fame and connected by a link to one of said pair of links. One or more free weight plates are mounted to the resistance arm which provides a predetermined resistance to the movement arm. The frame has a rack for mounting weight plates at a height at the level of the waist-chest area of the exerciser to facilitate movement of the weight plates between the rack and resistance arm. A prop is provided on the frame for holding the weight arm in the raised position to facilitate entry to and exit from the machine.

11 Claims, 6 Drawing Sheets

LEG PRESS MACHINE

FIELD OF INVENTION

The present invention generally relates to leg press exercise machines of the type including a movement arm in the form of a foot member engageable and movable by the feet of an exerciser against the opposition of a resistance typically one or more weights attached or connected to or mounted on the movement arm.

OBJECTS OF THE PRESENT INVENTION

An object of the present invention is to provide a novel and improved leg press machine of the type described above.

Another object of the present invention is to provide in such a leg press machine a linkage mechanism which mounts the movement arm to the stationary frame such that the work force required to initially move the movement arm increases as the movement arm is extended from a starting position adjacent the exerciser and an extended position displaced away from the exerciser.

A further object of the present invention is to provide a novel and improved leg press machine which facilitates entry to and exit from the machine.

Another object of the present invention is to provide a novel and improved leg press machine which facilitates the handling of free weights from a storage area on a frame of the machine to a resistance arm which is connected to the movement arm to oppose movement of the movement arm in one direction.

SUMMARY OF PREFERRED EMBODIMENT OF THE PRESENT INVENTION

One preferred embodiment of the present invention includes a movement arm mounted to a fixed frame by a pair of links pivotally connected to the movement arm and pivotally connected to the frame for allowing movement of the movement arm including a foot board between a first or start position adjacent the exerciser and an extended position displaced away from the exerciser. Movement of the movement arm towards the extended position is opposed by a resistance including a resistance weight arm pivotally mounted to the frame while also being connected to one of said pairs of links by another link. One or more free weights are mounted to the resistance weight arm. The frame includes a storage rack for storing resistance weights at a convenient level in the waist-chest area of the exerciser to facilitate the handling of the weights between the storage rack and the resistance weight arm. In order to facilitate entrance to and exit from the machine, a prop is mounted to the stationary frame for movement between an idle position where it is spaced from the weight arm and an active position wherein it engages the weight arm and holds it in a raised position allowing entrance to or exit from the machine by the exerciser. The prop arm is moved between its positions by a handle conveniently within the reach of the exerciser.

DRAWINGS

Other objects an advantages of the present invention will become apparent from the following detailed description taken in conjunction with the accompanying drawings in which.

Figure 4:
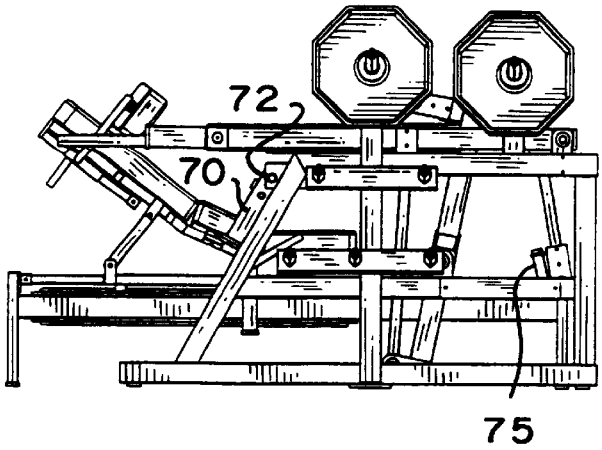
FIGS. 4, 5 and 6 are views corresponding to FIGS. 1, 2 and 3 respectively however with the machine shown in a different position which occurs at the start of an exercise.
Figure 5:
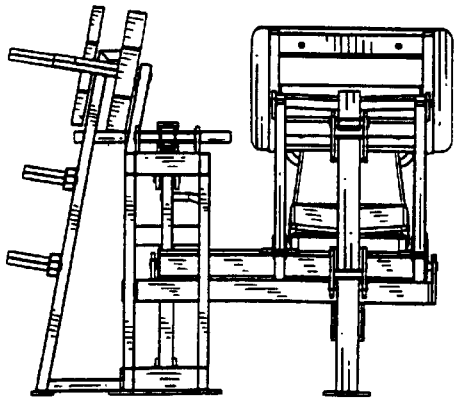
Figure 6:
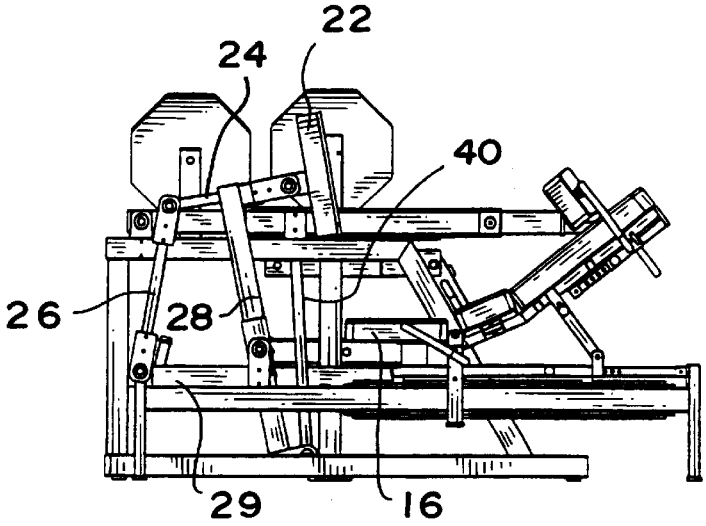
Figure 7:
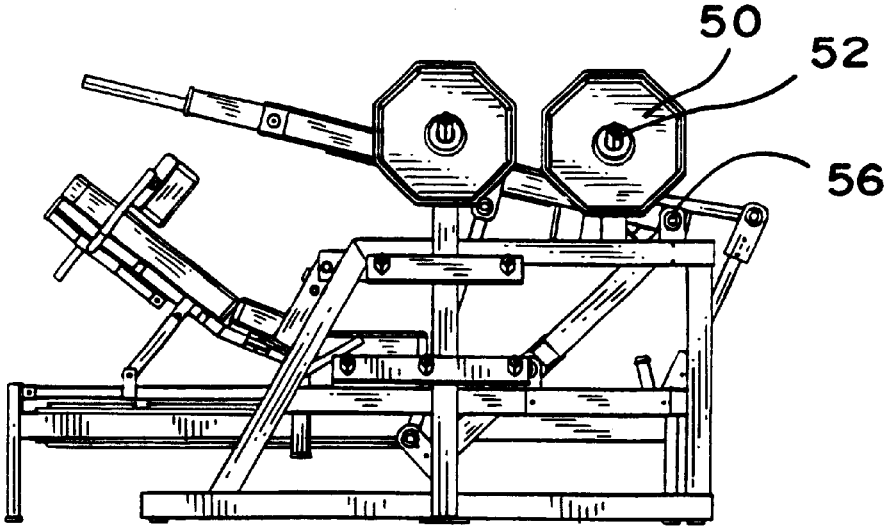
Figure 8:
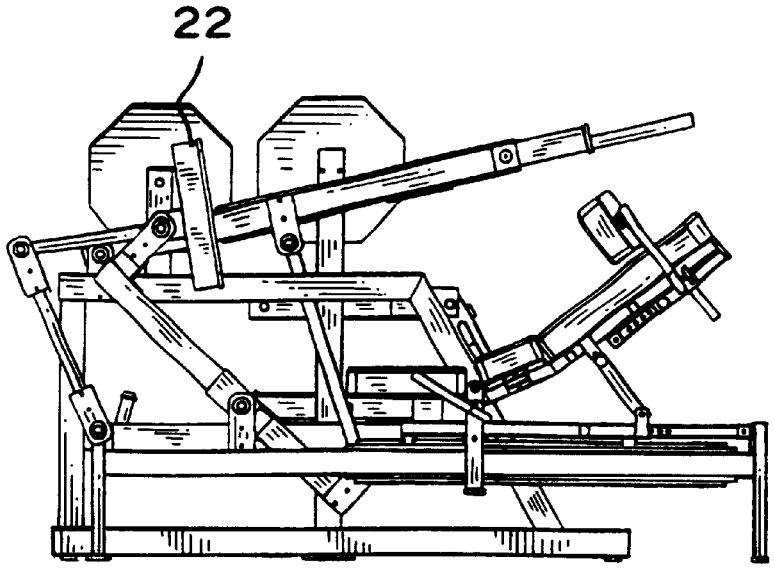
Figure 9:
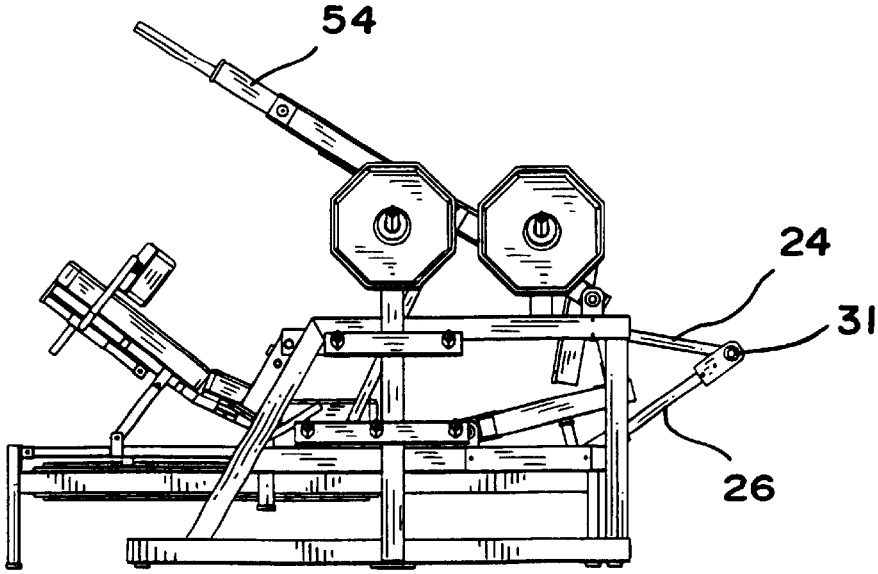
Figure 10:
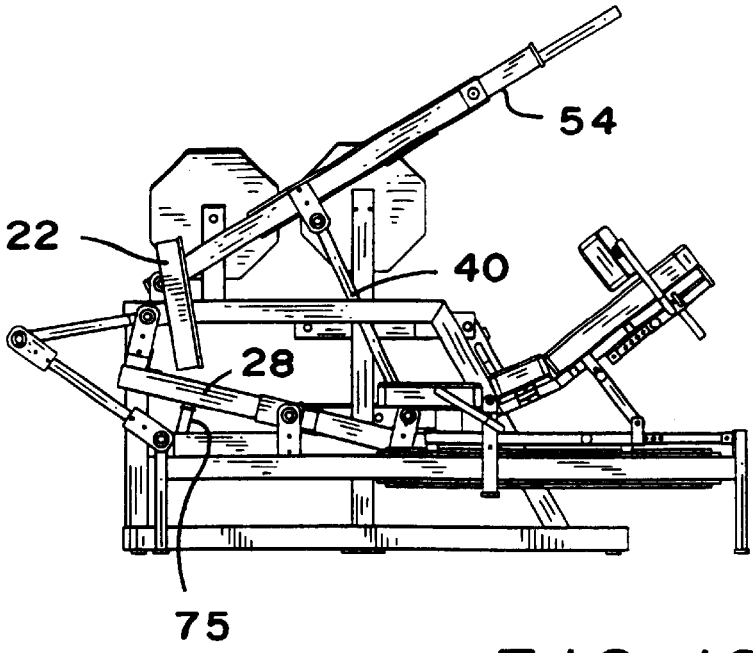
Figure 11:
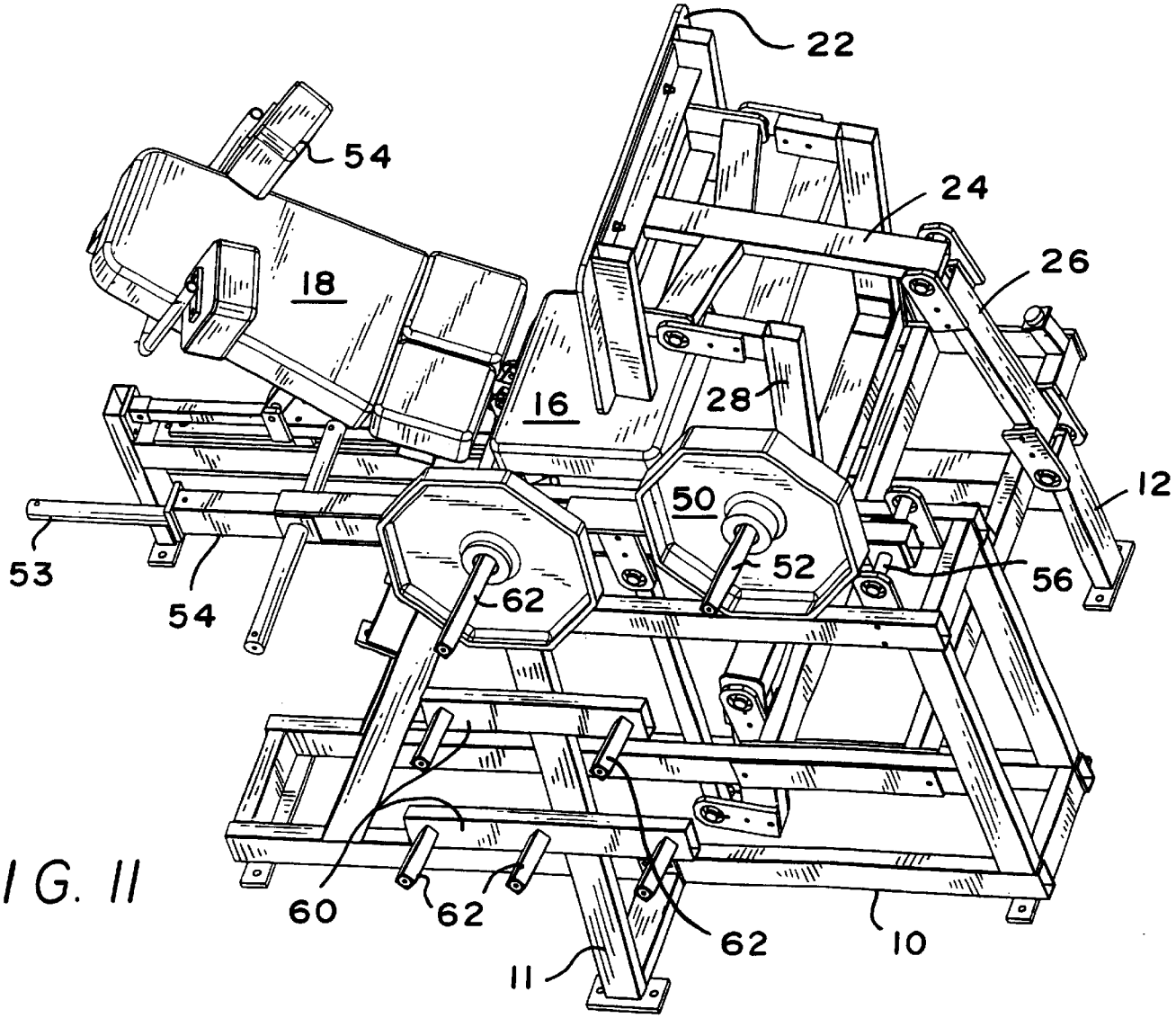
Figure 12:
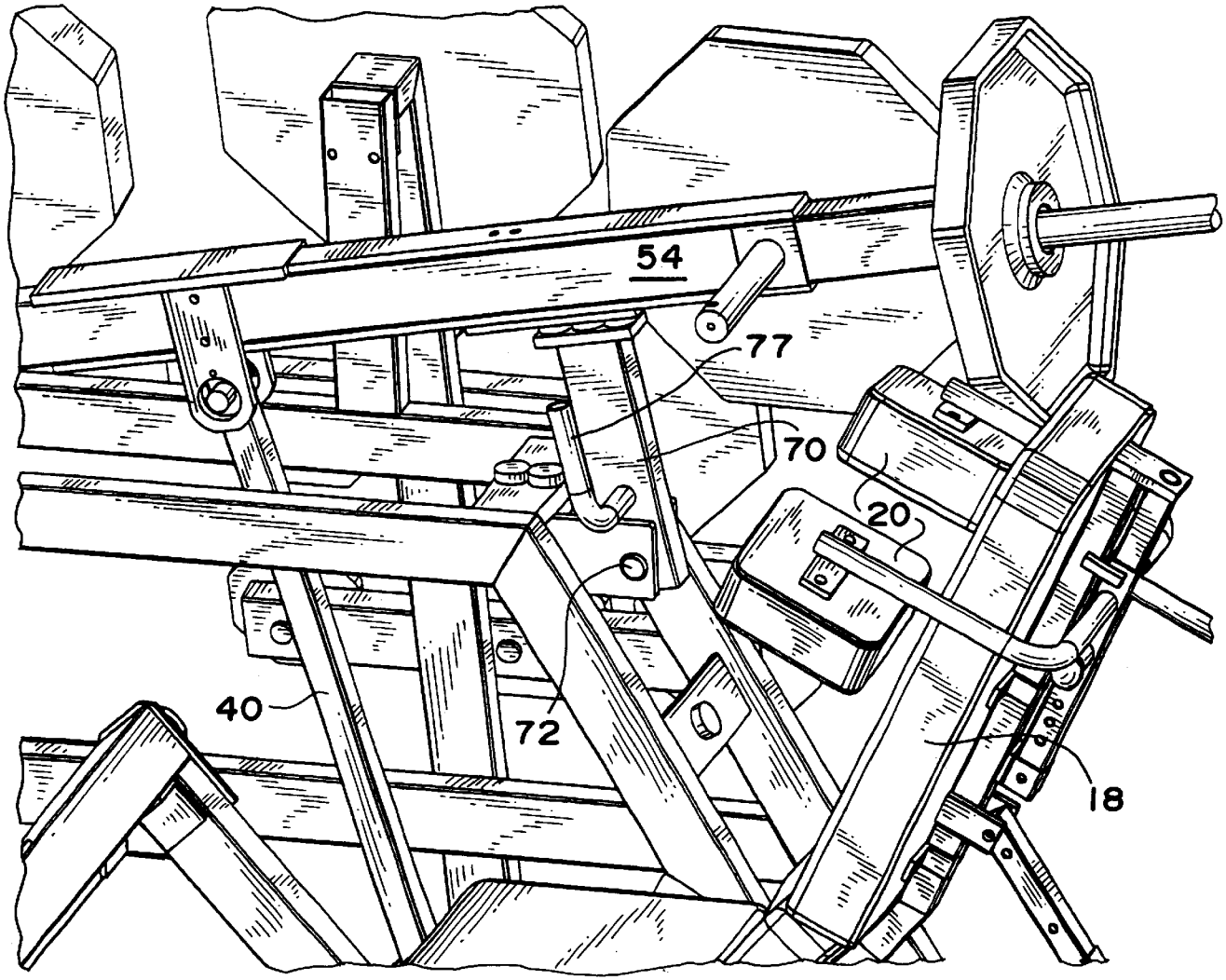

FIGS. 7 and 8 are views corresponding to FIGS. 4 and 6 but with the machine shown in a different position when the movement arm has been moved forwardly beyond the position shown in FIGS. 4, 5 and 6;

FIGS. 9 and 10 are views corresponding to FIGS. 7 and 8 but with the machine shown with the movement arm shown in a fully extended position;

FIG. 11 is a perspective view of the machine when in the position corresponding to that shown in FIGS. 4, 5 and 6;

FIG. 12 is a fragmental perspective view to enlarged scale of a portion of the machine showing a prop holding the weight arm in the raised position to facilitate entrance to and exit from the machine.

DETAIL DESCRIPTION

Figure 1:
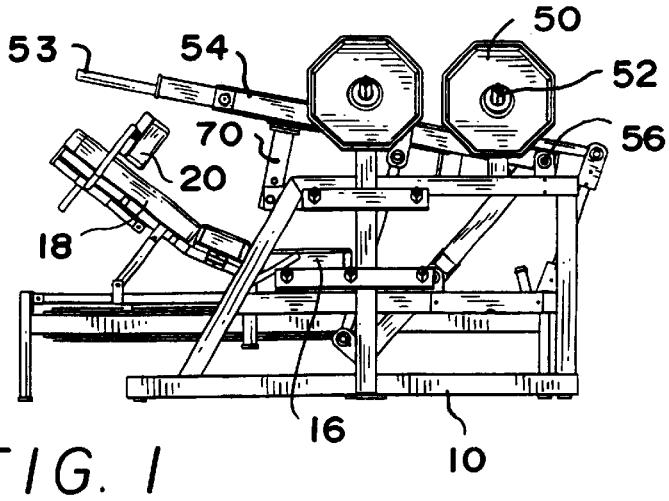
FIG. 1 is a right-side elevational view of a leg press exercise machine constituting a preferred embodiment of the present invention shown at rest with a prop holding a weight plate arm in a raised position facilitating entrance to and exit from the machine by the exerciser.
Figure 2:
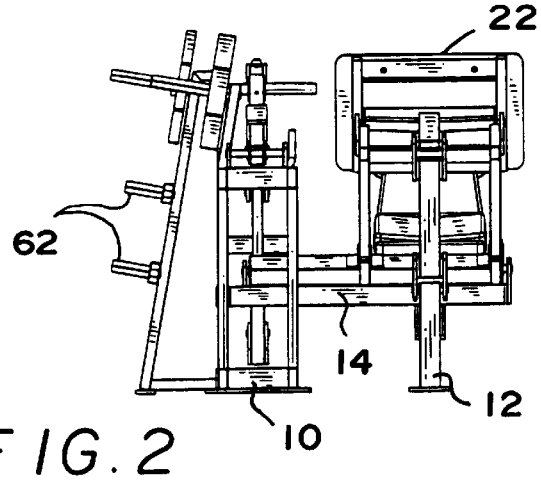
FIG. 2 is a front-end elevational view of the machine shown in FIG. 1.
Figure 3:
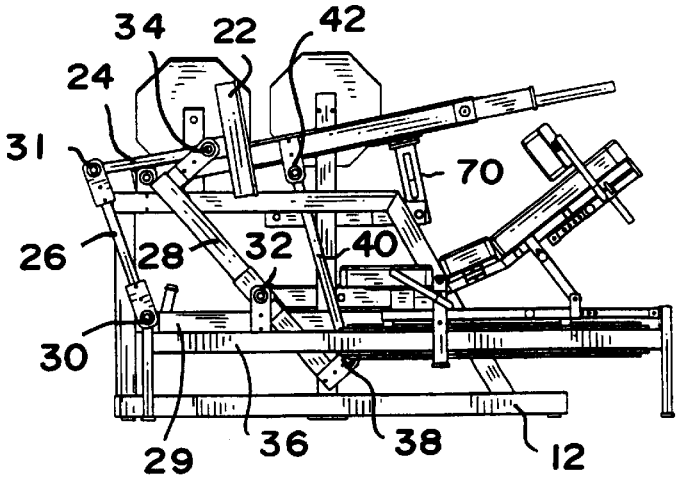
FIG. 3 is a left-side elevational view of the machine when in the position corresponding to that of FIG. 1.

Referring now to the drawings in detail there is shown for illustration purposes only a leg press exercise machine constituting a preferred embodiment of the present invention and including a stationary frame including a right-hand portion generally designated 10 and a left-hand portion generally designated 12 interconnected by a horizontal cross member 14, as best shown in FIGS. 1, 2 and 3. The frame maybe constructed in any suitable manner for example structural steel or alloy frame members. Suitably mounted on the frame is a seat 16, and back rest 18, for supporting an exerciser with the legs bent at the knees in a start position and an extended or finished position achieved by pressing the feet on a foot board included in movement arm generally designated 22. Back rest 18 is provided with a pair of shoulder rests generally designated 20, engageable on the shoulders during the exercise.

Referring to FIGS. 3 and 11, the foot board 22, in the preferred embodiment has a generally planar shape and is fixed to a link 24, which in turn is mounted to the frame by a pair of mounting links 26 and 28 pivoted by pivot pins 31 and 34 to link 24 and pivoted by pivot pins 30 and 32 to a horizontal frame portion 29. FIGS. 4 through 6 show the start position of the exerciser wherein the foot board 22, is located adjacent the exerciser with the legs bent at the knees with the feet engaging the foot board 22. FIGS. 7 and 8 show the foot board 22, advanced from the position shown in FIGS. 1 through 3 achieved by the exerciser continuing to press against foot board 22 while moving the legs toward extended position. FIGS. 9 and 10 show the finished position of the exerciser where the foot board 22, has been advanced to its extreme position. During such movement mounting links 26 and 28, move from the position shown in FIG. 3 through the position shown in FIG. 8 and into the extreme position shown in FIG. 10 which is also defined by a stop 75, engaged by link 28, as shown in FIG. 10. In the preferred embodiment shown links 26 and 28, are generally parallel to each other.

Movement of the foot board 22, from the retracted or normal position to the extended position shown in FIG. 10, is resisted by a resistance mechanism including a resistance weight arm generally designated 54, and one or more weight plates which are free weights 50, mounted to arm 54, by a horn 52, as shown in FIGS. 1 and 11. Resistance weight arm 54 is pivotally mounted at pivot 56, to the stationary frame for movement between the start position shown in FIGS. 4 through 6 and the finished position shown in FIGS. 9 and 10. Such movement of the weight arm 54, is achieved through a linkage including link 40, pivotally connected at pivot pin 42, to the weight arm 54, and pivotally connected to the lower end of the mounting link 28, by pivot pin 38. Thus motion of the mounting links 26 and 28 is transferred to weight arm 54, to raise the weight arm when the foot board 22, is moved to extended positions. When the exerciser releases pressure on the foot board 22, the foot board 22 will return to the start position under the force of the weight arm 54 and free weights 50. The dimensions and arrangement of links 26, 28, 40, and portions of the frame between the pivot pins and portions of the weight arm 54, between the pivot pins are such that in the beginning of an exercise, less force is required to move the foot board 22, during the initial phase of movement from the start position but as the foot board 22, is extended the force required to move the foot board 22, gradually increases to a peak just short of a fully extended or finished position. This compensates for the fact that in the initial start position, less force is available to the exerciser for moving the foot rest but the exerciser's available force gradually increases as the foot board continues to be extended.

In a preferred embodiment of the present invention, free weight plates 50, may be stored on the frame of the machine at various vertical elevations including an elevation which lies within the waist-chest area of the exerciser so as to facilitate movement of the plates between storage and the resistance weight arm 54. In a preferred embodiment shown, a plurality of weight plate horns 62 are provided on a rack including a vertical frame member 11 and horizontal members 60 fixed to vertical member 11, as best shown in FIG. 11. Additionally, shown in FIG. 11 is a horn 52, fixed to the weight arm 54 for receiving a weight plate 50 at the waist-chest level. A horn 53, may also be provided at the end of weight arm 54, for receiving additional weight plates 50.

In the preferred embodiment of the present invention shown in FIG. 1, a prop arm 70, holds the weight arm 54, in a raised position with the foot board 22, advanced somewhat away from the start position. Once the exerciser enters the machine and is in place ready to start the exercise, the weight arm 54, is lifted by pressing the foot board 22, and pivoting the prop arm 70, out of the way allowing the foot board to be extended to maximum extended position. Once the exercise is complete, the foot board 22, is pressed until the prop arm 70, can be swung back into the position shown in FIG. 1 to support the weight arm 54, to facilitate exit from the machine. In the preferred embodiment, prop arm 70 is pivotally mounted to the frame by pivot 72, shown in FIGS. 4 and 12. A handle 77, is fixed to prop arm 70, for rotating it between the active position engaging the weight arm 54, shown in FIG. 12 and the idle position disengaged from weight arm 54, as shown in FIG. 4.

Although one preferred embodiment of the present invention has been shown and described above, it will be appreciated by those of ordinary skill in the art that various modifications and adaptations of the present invention may be made but without departing from the spirit and scope of the present invention which is defined in the appended claims.

What is claimed is:

1. A leg press machine comprising in combination, a frame including a seat for an exerciser, a movement arm engagable by the feet of an exerciser for movement between retracted and extended positions, a pair of links mounting the movement arm to the frame between said retracted and extended positions, one of said links being pivotally mounted to the frame by a pivot located intermediate opposite ends of said one link, a resistance arm pivotally mounted to said frame, and a third link pivotally connected to said resistance arm and said one of said pair of links at a location below said pivot whereby the force required of the exerciser to move the movement arm from the retracted towards the extended position increases after initial movement from the retracted position.

2. The machine defined in claim 1, including a prop pivotally mounted to said frame for movement between an active position supporting said resistance arm and an inactive position spaced from said resistance arm.

3. The machine defined in claim 2 including a rack on said frame for storing resistance weights at a level in the waist-chest area of an exerciser to facilitate handling of said resistance weights, means on said rack for removably receiving a free weight, and said resistance arm having means for removably receiving a free weight from said rack.

4. The machine defined in claim 2, wherein said third link is pivotally mounted to the resistance arm and said one pair of links at location between said one pair of links and said seat.

5. The machine defined in claim 1, including a rack on said frame for storing resistance weights at a level in the waist-chest area of an exerciser to facilitate handling of said resistance weights, means on said rack for removably receiving a free weight, and said resistance arm having means for removably receiving a free weight from said rack.

6. The machine defined in claim 1, further including a stop fixed to the frame and engaging one of said pair of links when the movement arm is in a fully extended position.

7. The leg press machine defined in claim 1 wherein said resistance arm is movable between a lower position extending generally in a horizontal plane and a raised position extending above and at an angle to said horizontal plane, the raised position being achieved by an exerciser moving the movement arm with his feet in one direction from a starting position, and said lower position being achieved when the exerciser returns his feet to the starting position, and at least one free resistance weight removably mounted on said resistance arm for movement with said resistance arm between said positions of said resistance arm.

8. A leg press machine comprising in combination, a frame including a seat for an exerciser, a movement arm engagable by the feet of an exerciser for movement between retracted and extended positions, a pair of links mounting the movement arm to the frame between said retracted and extended positions, a resistance arm pivotally mounted to said frame, at least one free resistance weight removably mounted on said resistance arm for movement with said resistance arm, and a prop pivotally mounted to said frame for movement between an active position supporting said resistance arm, at a position spaced above the seat for permitting the exerciser to exit the machine, and an inactive position spaced from said resistance arm.

9. The machine defined in claim 8 including a rack on said frame for storing resistance weights at a level in the waist-chest area of an exerciser to facilitate handling of said resistance weights, said rack having horns for receiving free resistance weights.

10. The machine defined in claim 8 including a third link pivotally interconnecting one of said pair of links and said resistance arm, said one link being pivotally connected to the frame at a location intermediate the ends thereof, and said third link being pivotally connected to said one link below said location.

11. The leg press machine defined in claim 8 the wherein said resistance arm is movable between a lower position extending generally in a horizontal plane and a raised position extending above and at an angle to said horizontal plane, the raised position being achieved by an exerciser moving the movement arm with his feet in one direction from a starting position, and said lower position being achieved when the exerciser returns his feet to the starting position, and at least one free resistance weight removably mounted on said resistance arm for movement with said resistance arm between said positions of said resistance arm.

* * * * *